United States Patent [19]

Tsuchihashi et al.

[11] 4,321,506

[45] Mar. 23, 1982

[54] DISCHARGE LAMP AND LIGHTING EQUIPMENT

[75] Inventors: Michihiro Tsuchihashi, Kamakura; Ryohei Itatani, Kyoto; Masatoshi Ryohko, Akashi; Yutaka Murai, Amagasaki, all of Japan

[73] Assignee: Mitsubishi Denki Kabushiki Kaisha, Tokyo, Japan

[21] Appl. No.: 104,804

[22] Filed: Dec. 18, 1979

[30] Foreign Application Priority Data

Dec. 22, 1978 [JP] Japan ..... 53/158366

[51] Int. Cl.[3] ..... H01J 7/44; H01J 17/34; H01J 19/78; H01K 1/62

[52] U.S. Cl. ..... 315/35; 315/46; 315/48; 315/178; 315/183

[58] Field of Search ..... 315/46, 47, 48, 49, 315/63, 178, 182, 183, 35

[56] References Cited

U.S. PATENT DOCUMENTS

| | | | |
|---|---|---|---|
| 2,017,719 | 10/1935 | Inman | 315/48 X |
| 2,203,550 | 6/1940 | Spanner | 315/49 |
| 2,208,998 | 7/1940 | Mey | 315/49 |
| 2,252,474 | 8/1941 | Spanner | 315/46 X |
| 2,297,258 | 9/1942 | Spanner | 315/46 X |
| 3,931,543 | 1/1976 | Nuckolls | 315/183 |
| 4,082,981 | 4/1978 | Morton et al. | 315/49 |

FOREIGN PATENT DOCUMENTS

| | | | |
|---|---|---|---|
| 836532 | 4/1952 | Fed. Rep. of Germany | 315/49 |

*Primary Examiner*—Saxfield Chatmon, Jr.
*Attorney, Agent, or Firm*—Oblon, Fisher, Spivak, McClelland & Maier

[57] ABSTRACT

A discharge lamp comprises a high pressure arc tube for high pressure and a low pressure arc tube for low pressure which is electrically connected in parallel to said high pressure arc tube in an outer tube.

A lighting equipment comprises a high pressure arc tube for high pressure discharge and a low pressure arc tube for low pressure which is electrically connected in parallel to said high pressure arc tube; and a high frequency lighting starter having 1 KHz to 100 KHz for starting the discharge of said high pressure arc tube.

6 Claims, 4 Drawing Figures

DISCHARGE LAMP AND LIGHTING EQUIPMENT

BACKGROUND OF THE INVENTION

1. Field of the Invention

The present invention relates to a novel discharge lamp in which a high pressure arc tube for high pressure discharge is electrically connected in parallel to a low pressure arc tube for low pressure discharge and both arc tubes are placed in an outer tube. This novel lighting equipment starts the low pressure arc tube and the high pressure arc tube with a high frequency lighting starter.

2. Description of the Prior Arts

In general, the mercury pressure in a high pressure arc tube is about several atm. during the lighting of the discharge lamp in a high pressure mercury vapor discharge lamp, a metal halide vapor discharge lamp or a high pressure sodium vapor lamp which have three to ten times the luminous efficiency of an incandescent lamp. Therefore, when the discharge lamp is once turned off by a temporary power voltage drop or a temporary service interruption, the discharge lamp is not able to start immediately even though the power voltage has returned to the normal level.

It has been difficult to start the lamp until the temperature in the arc tube is lowered to decrease the mercury vapor pressure in the arc tube to the level required for the start. The time required for the restart of the discharge is called the restart time which is about 3 to 5 minutes in the high pressure mercury vapor discharge lamp, 8 to 15 minutes in the metal halide vapor discharge lamp and 1 to 2 minutes in the high pressure sodium vapor discharge lamp which is started with a ballast equipped with a high voltage pulse generator, and 2 to 10 minutes in the high pressure sodium vapor discharge lamp which is started with a ballast having no high voltage pulse generator. Thus, the high pressure discharge lamps which require a long restart period are not satisfactory, in their uses.

When a high pressure discharge lamp having high efficiency is being considered to take the place of the incandescent lamp which is mainly used as a light source but has a quite low efficiency, the disadvantageous long restart period should be considered.

A ballast is required for starting the high pressure discharge lamp, which is large and heavy and accordingly, is assembled separately from the discharge lamp. Therefore, it has been impossible to consider the replacement of the incandescent lamp by a combination of the ballast and the discharge lamp.

SUMMARY OF THE INVENTION

It is an object of the present invention to overcome the above-mentioned disadvantages and to provide a discharge lamp which is usually started by a high pressure arc tube and also continues an emission by a discharge caused by a low pressure arc tube during the time from extinction to restart of the high pressure arc tube so as to prevent the extinction of the discharge lamp.

It is another object of the present invention to provide lighting equipment which is compact, has high efficiency and can be used in place of an incandescent lamp.

The foregoing and other objects of the present invention have been attained by providing a discharge lamp which comprises a high pressure arc tube for high pressure discharge and a low pressure arc tube for low pressure discharge connected in parallel and contained in an outer tube.

BRIEF DESCRIPTION OF THE DRAWINGS

FIGS. 1 and 2 show one embodiment of the present invention wherein FIG. 1 is a front view of a discharge lamp; and FIG. 2 is a circuit diagram using the discharge lamp;

FIGS. 3 and 4 show the other embodiment wherein FIG. 3 is a front view of a lighting equipment and FIG. 4 is a circuit diagram using the lighting equipment.

DETAILED DESCRIPTION OF THE PREFERRED EMBODIMENTS

Figure 1:
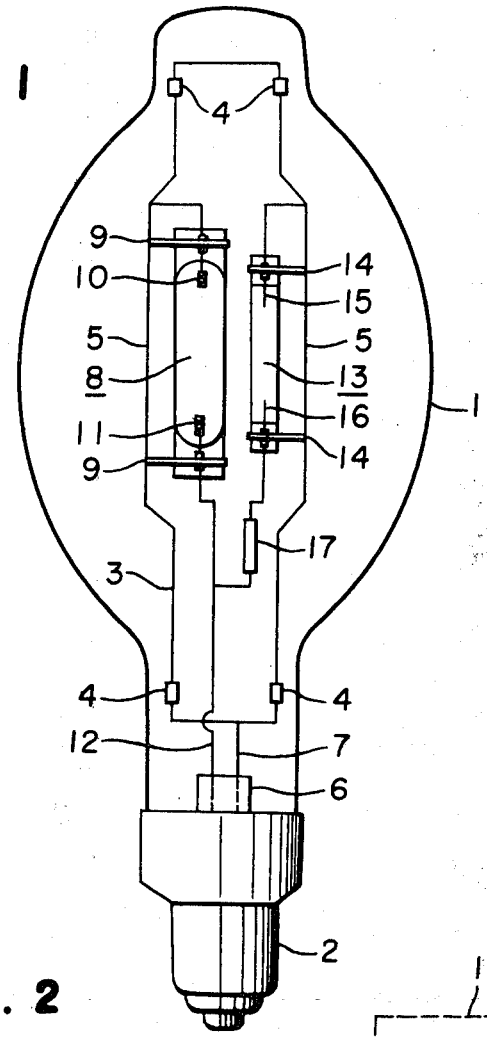
Figure 2:
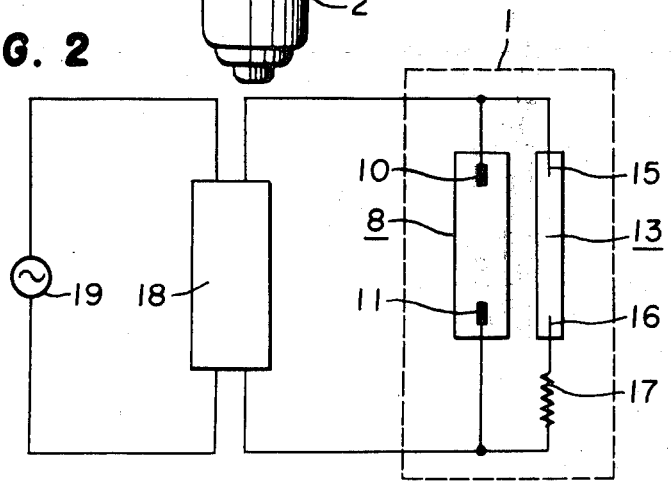

Referring to FIGS. 1 and 2, one embodiment of the present invention will be illustrated.

In FIGS. 1 and 2, the reference numeral (1) designates an outer tube made of a light transmissable glass having an egg shape which is equipped with a base (2) at one end; (3) designates a support frame having parallel support wires (5),(5) which are held by each plate spring (4),(4) in the outer tube and the support frame is connected to the base (2) and is electrically connected to a stem lead (7) projected from the stem (6). The reference numeral (8) designates a high pressure arc tube such as the 400 W metal halide vapor arc tube for high pressure discharge which is held through a pair of support plates (9),(9) to the support wire (5) of the support frame (3). A pair of electrodes (10),(11) are respectively provided at both ends in the sealed tube and one electrode (10) is electrically connected to the support frame (3), and the other electrode (11) is electrically connected to the stem lead (12) projected from the stem (6) connected to the base (2). The reference numeral (13) is a low pressure arc tube for low pressure discharge which is held through a pair of support plates (14),(14) to the other support wire (5) of the support frame (3) and the low pressure arc tube has a pair of electrodes (15),(16) at each end, and has an inner diameter of 6 mm and a distance between the electrodes (15),(16) of 20 mm and contains a pressurized mixed gas consisting of 99% of neon and 1% of argon under a pressure of 10 torr.

One electrode (15) of the low pressure arc tube (13) is electrically connected to the support frame (3) and the other electrode (16) is electrically connected through an impedance element (17) such as a resistor having 180 [Ω] to the stem lead (12). That is, the series connection of the low pressure arc tube (13) and the impedance element (17) is connected in parallel to the high pressure arc tube and these elements are placed in the outer tube (1).

As shown in FIG. 2, the discharge lamp having said structure is connected through a ballast (18) to a power source (19). When the power voltage is applied, the discharge of the high pressure arc tube (8) starts and a current controlled by the ballast (18) is fed to the high pressure arc tube (8). The tube reaches a stable state about 5 minutes after the discharge start. Sometimes, the discharge of the low pressure arc tube (13) simultaneously starts for a moment when the discharge of the high pressure arc tube (8) is started. However, an impedance element (17) having a relatively high impedance such as 180Ω (resistor) is connected in series to the low pressure arc tube (13) so as to control the current passing through the low pressure arc tube (13) to about 1

Amp. When the arc current having 5 to 6 Amp. passes through the high pressure arc tube in the starting period, the voltage between the electrodes (10), (11) of the high pressure arc tube (8) is decreased to 20 to 30 volt, and the voltage between the electrodes (15),(16) of the low pressure arc tube (13) is decreased whereby the discharge of the low pressure arc tube (13) is stopped and only the discharge of the high pressure arc tube (8) continues.

In the stable state of the high pressure arc tube (8), a current of 3 to 4 Amp. passes through the circuit of the base (2)- stem lead (12)-electrode (11)-electrode (10)-support frame (3)-stem lead (7)-base (2) to the ballast, however no current passes through the circuit of the low pressure arc tube (13) and the impedance element (17) so that the high pressure arc tube (8) maintains the stable state and the low pressure arc tube (13) is kept in the non-discharge state.

When the high pressure arc tube (8) is extinguished from the stable state by a temporary voltage drop of the power voltage, even though the power voltage is returned to the normal level, the pressure in the high pressure arc tube (8) is as high as several atm. whereby the discharge of the high pressure arc tube (8) is not capable of starting. Thus, when the power voltage is applied to the high pressure arc tube (8) in such a state, the low pressure arc tube (13) is capable of starting. Therefore, the low pressure arc tube (13) is immediately started when the high pressure arc tube (8) is extinguished. The lighting is continued by the low pressure arc tube (13). Therefore, the discharge lamp continues light emission corresponding to the light emission characteristics of the low pressure arc tube (13) without causing a complete inactuation of the discharge lamp. In this condition, a current of 1 Amp. controlled by the impedance element (17) passes through the circuit of the base (2)-stem lead (12)-impedance element (17)-electrode (16)-electrode (15)-support frame (3)-stem lead (7)-base (2) to the ballast (18), whereas no current passes through the high pressure arc tube (8).

When the temperature of the high pressure arc tube (8) is decreased under the condition of the actuation of the low pressure arc tube (13), and the mercury vapor pressure in the arc tube is decreased so as to be capable of restarting, the discharge of the high pressure arc tube (8) is started again, the stable state is reached after 5 minutes and the light emission having desired electrical and optical characteristics is continued. In this example, the time required for the restart of the discharge of the high pressure arc tube (8) is about 10 minutes. When the discharge of the high pressure arc tube (8) is started again, the discharge of the low pressure arc tube (13) is stopped because of the same conditions present at the original start of the discharge lamp. Therefore, the low pressure arc tube (13) is not actuated during the actuation of the high pressure arc tube (8).

In this embodiment, the impedance element (17) is connected in series to the low pressure arc tube (13). When the glow discharge is continued in the state applying the power voltage to the low pressure arc tube (13), it is possible to eliminate the impedance element (17) only by the parallel connection of the low pressure arc tube (13) and the high pressure arc tube (8).

In said emebodiment, a 400 W metal halide arc tube is used as the high pressure arc tube (8). It is not necessary to use a 400 W arc tube and it is possible to use arc tubes for high pressure mercury vapor discharge lamps and high pressure sodium vapor discharge lamps, etc. An arc tube containing a mixed gas of neon and argon is used as the low pressure arc tube. Thus, it is possible to use an arc tube for low pressure mercury vapor discharge lamps, a fluorescent lamp or a rare gas discharge lamp. The pressure of the sealed gas in the low pressure arc tube (13) is preferably lower than 100 torr so as to start the discharge by the normal voltage.

In this embodiment, a resistor is used as the impedance element (17) connected in series to the low pressure arc tube (13). Thus, it is possible to use a capacitor, a choke coil, a filament coil or a combination of two or more of the capacitor, the choke coil, and the filament coil or the resistor as the impedance element.

The impedance of the impedance element (17) can be selected as desired depending upon the characteristic of the low pressure arc tube (13).

When a filament coil is used as the impedance element (17), certain light emission from the filament coil is produced during the actuation of the low pressure arc tube (13) before the restart of the high pressure arc tube (8).

Figure 3:
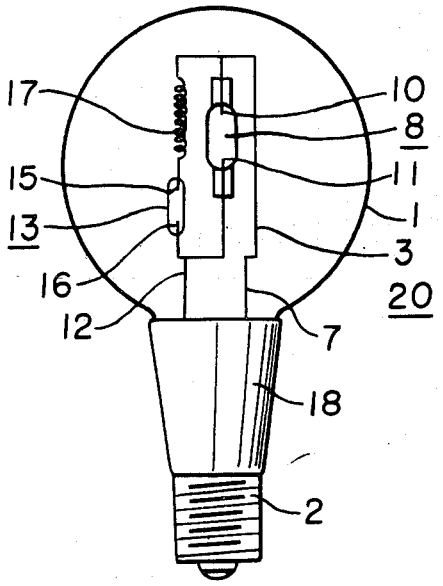
Figure 4:
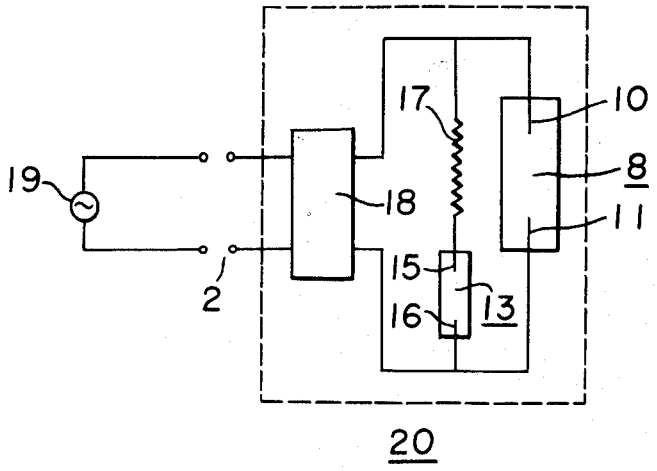

FIGS. 3 and 4 show the other embodiment of the present invention wherein the reference numeral (20) designates a lighting equipment comprising a light transmiscible outer tube (1), the high frequency lighting starter (18) and a base (2). In the outer tube (1), a high pressure arc tube (8), a tungsten filament (17) and a low pressure arc tube (13) are placed. The high pressure arc tube (8) has electrodes (10),(11) at each end, and one electrode (10) is connected to a support lead (3) and the other electrode (11) is connected to a lead (12) of the lighting starter (18). The support lead (3) is connected to the other lead (7) of the lighting starter (18). The electrode (15) of the low pressure arc tube (13) having electrodes (15),(16) is connected through the tungsten filament (17) to the support lead (3) and the electrode (16) is connected to the lead (12). Therefore, the low pressure arc tube (13) connected in series to the filament (17) is electrically connected in parallel to the high pressure arc tube (8). The lead of the lighting starter (18) at the power source side is connected to the base (2). The high pressure arc tube (8) can be a 30 W metal halide arc tube in which mercury, argon and scandium halide and sodium halide are filled in the sealed condition. The low pressure arc tube (13) can be a rare gas arc tube having an inner diameter of 5 mm and a distance between the electrodes (15),(16) of 10 mm and containing pressurized mixed gas consisting of 99% of neon and 1% of argon under the pressure of 20 torr. The impedance element can be a tungsten filament (17) having 400Ω for controlling the current in the low pressure arc tube (13) to 0.2 Amp. A rare gas is filled in the outer tube (1) so as to prevent the vaporization of tungsten from the filament and to prevent the oxidation of the elements placed in the outer tube.

The lighting equipment having such structure is connected to the power source (19) as shown in FIG. 4 whereby the high frequency voltage generated by the high frequency lighting starter (18) is applied to the arc tube and the discharge of the high pressure arc tube (8) is started to pass the current controlled by the lighting starter (18) through the high pressure arc tube (8).

The high pressure arc tube (8) reaches a stable state about 3 minutes after the start of the discharge. When the discharge of the high pressure arc tube (8) is started, sometimes, the discharge of the low pressure arc tube (13) is simultaneously started for a moment.

A filament having a relatively high resistance of 400Ω is connected as the impedance element (17) (resistor) to the low pressure arc tube (13). Therefore, the current passing through the low pressure arc tube is limited to 0.2 Amp. When the arc discharge current of 0.6 to 0.65 Amp. is passed through the high pressure arc tube at the start, the voltage applied between the electrodes (10),(11) of the high pressure arc tube (8) is decreased to about 20 Volt, and the voltage applied between the electrodes of the low pressure arc tube (13) is lowered to stop the discharge in the low pressure arc tube (13) so that only the high pressure arc tube (8) continues the discharge.

In the stable state of the high pressure arc tube (8), the current passes through the circuit of the base (2)-lighting starter (18)-lead (7)-support lead (3)-electrode (10)-electrode (11)-lead (12)-lighting starter (18)-base (2) whereas no current passes through the low pressure arc tube (13) and an impedance element (17) whereby the high pressure arc tube (8) maintains the stable state whereas the low pressure arc tube (13) continues the non-discharge state.

When the high pressure arc tube (8) is extinguished from the stable state by a temporary voltage drop of the power voltage, even though the power voltage is returned to the normal level, the pressure in the high pressure arc tube (8) is as high as several atm. whereby the discharge of the high pressure arc tube (8) is not capable of starting. Thus, when the power voltage is applied to the high pressure arc tube (8) in such a state of, the low pressure arc tube (13) is capable of starting. Therefore, the low pressure arc tube (13) is immediately started when the high pressure arc tube (8) is extinguished. The lighting is continued by the low pressure arc tube (13) and the tungsten filament (17). Therefore, the discharge lamp continues light emission corresponding to the light emission characteristics of the low pressure arc tube (13) and the tungsten filament (17) without causing a complete inactivation of the discharge lamp.

During the state, the high frequency current of 0.2 Amp. which is controlled by the filament (17) as the impedance element passes through the circuit of the base (2)-lighting starter (18)-lead (7)-support lead (3)-filament (17) as the impedance element-electrode (15)-electrode (16)-lead (12)-lighting starter (18)-base (2) whereas no current passes through the high pressure arc tube (8).

When the temperature of the high pressure arc tube (8) is decreased under the condition of the activation of the low pressure arc tube (13) and the mercury vapor pressure in the arc tube is decreased so as to be capable of restarting, the discharge of the high pressure arc tube (8) is started again the stable state is reached after 3 minutes, and the light emission having desired electrical and optical characteristics is continued. In this example, the time required for the restart of the discharge of the high pressure arc tube (8) is about 8 minutes. When the discharge of the high pressure arc tube (8) is started again, the discharge of the low pressure arc tube (13) is stopped because of the same conditions present at the original start of the discharge lamp. Therefore, the low pressure arc tube (13) is not actuated during the actuation of the high pressure arc tube (8).

The characteristics of the lighting equipment having an arc tube of a 30 W metal halide vapor discharge lamp and the characteristics of 100 W incandescent lamp are shown in Table 1.

As it is clear from the data of Table 1, the lighting equipment of the present invention has three times the efficiency of the incandescent lamp and five times the life of the incandescent lamp.

The luminous efficiency in Table 1 means efficiency of only the lamp as total luminous flux/lamp power and the total efficiency means total efficiency of the lamp and the ballast as total luminous flux/input power.

The 30 W metal halide vapor discharge lamp of this embodiment is activated by a high frequency current having 20 KHz and accordingly, the loss caused by the lighting starter is smaller than that of the conventional discharge lamp and the input power is 34 W.

TABLE 1

| Type | 100 W incandescent lamp | Lighting equipment having 30 W metal halide arc tube |
|---|---|---|
| Power of lamp (Watt) | 100 | 30 |
| Voltage of lamp (Volt) | — | 60 |
| Current of lamp (Amp.) | — | 0.56 |
| Total luminous flux (1m) | 1520 | 1500 |
| Luminous efficiency (1m) | 15.2 | 50 |
| Total efficiency (1m) | 15.2 | 44.1 |
| Life (hr.) | 1000 | 5000 |

In the embodiment shown in FIGS. 3 and 4, the tungsten filament as the impedance element (17) is connected to the low pressure arc tube (13). When the glow discharge is continued in the state applying the power voltage to the low pressure arc tube (13), it is possible to eliminate the impedance element (17) only the parallel connection of the low pressure arc tube (13) and the high pressure arc tube (8).

In this embodiment, a 30 W metal halide arc tube is used as the high pressure arc tube (8). Thus, it is not necessary to use a 30 W arc tube and it is possible to use arc tubes for high pressure mercury vapor discharge lamps and high pressure sodium vapor discharge lamps, etc. The arc tube containing a mixed gas of neon and argon is used as the low pressure arc tube. Thus, it is possible to use an arc tube for low pressure mercury vapor discharge lamps, a fluorescent lamp or a rare gas discharge lamp.

The pressure of the sealed gas in the low pressure arc tube (13) is preferably lower than 100 torr so as to start the discharge by the normal voltage.

In this embodiment, a resistor is used as the impedance element (17) connected in series to the low pressure arc tube (13). Thus, it is possible to use a capacitor, a choke coil, a filament coil, or a combination of two or more of the capacitor, the choke coil, and the filament coil or the resistor as the impedance element.

The impedance of the impedance element (17) can be selected as desired depending upon the characteristics of the low pressure arc tube (13).

When a filament coil is used as the impedance element (17), certain light emission from the filament coil is produced during the actuation of the low pressure arc tube (13) before the restart of the high pressure arc tube (8).

In said embodiment shown in FIGS. 3 and 4, the frequency of the voltage and the current for the starting the arc tube (8) or (13) by generating from the high frequency lighting starter (18) is 20 KHz. Thus, it is preferable to use the frequency ranging from 1 KHz to 100 KHz. When the frequency is less than 1 KHz, the compact and light weight of the lighting starter are not satisfactory. When the frequency is greater than 100 KHz, the extinction phenomenon caused by unstable discharge in the repeated starting of the high pressure arc tube (13) is caused, and this is a disadvantage in the practical use.

In accordance with the present invention, the high pressure arc tube for high pressure discharge is electrically connected in parallel to the low pressure discharge for low pressure arc tube and both arc tubes are placed in the outer tube whereby the discharge lamp is usually started by the high pressure arc tube having high efficiency and when the high pressure arc tube is extinguished by a certain condition, the low pressure arc tube is actuated during the period from the extinction to the restart of the high pressure arc tube to prevent the complete inactuation of the discharge lamp and to prevent complete darkness of the lighting part. A discharge lamp having remarkable advantages is thus obtained.

When the high pressure arc tube for high pressure discharge is electrically connected in parallel to the low pressure arc tube for low pressure discharge and both arc tubes are placed in the outer tube and are started by a high frequency lighting starter having 1 KHz to 100 Khz, the discharge lamp is usually started by the high pressure arc tube having high efficiency and when the high pressure arc tube is extinguished by a certain condition, the low pressure arc tube is actuated during the period from the extinction to the retart of the high pressure arc tube to prevent the complete inactuation of the discharge lamp and to prevent complete darkness of the lighting part. Moreover, the lighting starter can be compact so as to enable the arc tubes and the lighting starter to be assembled in one discharge lamp which can be used to take the place of the incandescent lamp in the lighting equipment. A lighting equipment having remarkable advantages is thus obtained.

I claim:

1. A discharge lamp comprising:

a high pressure arc tube for high pressure discharge;

a low pressure arc tube for low pressure discharge;

an impedance element electrically connected in series to said low pressure arc tube;

wherein said high pressure arc tube is electrically connected in parallel to said series connection of said low pressure arc tube and said impedance element;

wherein the relation of the value of the impedance to the conductivity characteristics of said low pressure arc tube and said high pressure arc tube is such that when said high pressure arc tube is conducting, said impedance element prevents said low pressure arc tube from conducting and when said high pressure arc tube is not conducting said impedance element allows said low pressure arc tube to conduct;

a ballast being connected in series with the parallel connection of said high pressure arc tube with said low pressure arc tube and said impedance element;

wherein said high pressure arc tube, said low pressure arc tube and said impedance element are assembled in an outer bulb; and wherein said high pressure arc tube being extinguished by one of a temporary voltage drop and being turned on shortly after being turned off and being incapable of restarting due to the high pressure in said high pressure arc tube, said low pressure arc tube is immediately started and continues until discharge of said high pressure arc tube is started again.

2. A discharge lamp according to claim 1 wherein said impedance element is a resistor.

3. A discharge lamp according to claim 1 wherein said impedance element is a filament coil.

4. A discharge lamp according to claim 1, 2 or 3 wherein said high pressure arc tube is an arc tube for a high pressure mercury vapor discharge lamp, a metal halide vapor discharge lamp or a high pressure sodium vapor discharge lamp.

5. A discharge lamp according to claim 4 wherein said low pressure arc tube is an arc tube for a low pressure mercury lamp, a fluorescent lamp or a rare gas discharge lamp.

6. A lighting device comprising:

a high pressure arc tube for high pressure discharge;

a low pressure arc tube for low pressure discharge;

an impedance element electrically connected in series to said low pressure arc tube;

wherein said high pressure arc tube is electrically connected in parallel to said serial connection of said low pressure arc tube and said impedance element;

wherein the relation of the value of the impedance to the conductivity characteristics of said low pressure arc tube and said high pressure arc tube is such that when said high pressure arc tube is conducting, said impedance element prevents said low pressure arc tube from conducting and when said high pressure arc tube is not conducting said impedance element allows said low pressure arc tube to conduct;

a high frequency ballast having one KHz to 100 KHz for operating the discharge of said high pressure arc tube and being connected in series with said parallel connection of said high pressure arc tube with said low pressure arc tube and said impedance element;

wherein said high pressure arc tube, said low pressure arc tube, said impedance element and said high frequency ballast are assembled in one lamp.

* * * * *